US006257114B1

(12) United States Patent
Murello

(10) Patent No.: US 6,257,114 B1
(45) Date of Patent: Jul. 10, 2001

(54) FIRING LEVER MECHANISM FOR FIREARMS

(75) Inventor: Johannes Murello, Rottweil (DE)

(73) Assignee: Heckler & Koch GmbH, Oberndorf/Necker (DE)

( * ) Notice: Subject to any disclaimer, the term of this patent is extended or adjusted under 35 U.S.C. 154(b) by 0 days.

(21) Appl. No.: 09/181,462

(22) Filed: Oct. 28, 1998

(30) Foreign Application Priority Data

Oct. 28, 1997 (DE) ..... 197 47 576

(51) Int. Cl.[7] ..... F41A 19/37
(52) U.S. Cl. ..... 89/1.42; 89/1.4
(58) Field of Search ..... 89/1.42, 1.4

(56) References Cited

U.S. PATENT DOCUMENTS

| | | | | |
|---|---|---|---|---|
| 3,686,998 | * | 8/1972 | Seifried | 89/1.4 |
| 3,774,498 | * | 11/1973 | Moller et al. | 42/71 |
| 5,214,233 | | 5/1993 | Weldle et al. | 89/1.4 |
| 5,821,445 | | 10/1998 | Guhring | 89/1.42 |

FOREIGN PATENT DOCUMENTS 196 13 987 A1 10/1997 (DE) .

OTHER PUBLICATIONS

*European Search Report*. Dated Aug. 12, 1998. Regarding European Patent Application Serial No. 98116220.9.

* cited by examiner

*Primary Examiner*—Stephen M. Johnson
(74) *Attorney, Agent, or Firm*—Marshall, O'Toole, Gerstein, Murray & Borun

(57) ABSTRACT

A firing lever mechanism for use with a firearm is disclosed. The firing lever mechanism includes a slide disposed for reciprocating movement between a distal position and a proximal position, and a first spring that biases the slide toward the distal position. A firing lever is mounted for pivotal movement between a rest position and an operating position. In the rest position, the firing lever is disposed in substantial alignment with the longitudinal axis of the firearm to facilitate grasping of the firing lever. When the firing lever is pivoted through a first predefined angle in a direction away from the operating position, the slide is released from the locked position. The first spring then moves the slide toward the distal position thereby pivoting the lever toward the operating position.

19 Claims, 6 Drawing Sheets

FIRING LEVER MECHANISM FOR FIREARMS

FIELD OF THE INVENTION

The invention relates generally to firearms, and, more particularly, to a firing lever mechanism for use with an automatic firearm.

BACKGROUND OF THE INVENTION

Firing levers in some prior art automatic firearms are rigidly connected to a bolt assembly, protrude on the outside of the weapon, and accompany the movement of the bolt assembly during each loading process. The protrusion of the firing lever from the weapon is disadvantageous because it creates a serious hazard that the firing lever will catch on a camouflage net, or on a branch or the like. Such catching would contribute to load impairment.

Another type of prior art firing lever, known from DE 196 13 987, has a rest position in which it lies in the center of the weapon above and parallel to the barrel. Only during loading, (i.e., during movement of the bolt by the hand of a shooter), is the firing lever clicked out laterally to the left or right from the bolt assembly (depending on whether the shooter is right-handed or lefthanded) so that it can be easily grasped. Upon release by the shooter, the firing lever clicks forward into its rest position.

However, in order to permit a shooter wearing thick gloves, mittens or the like to grasp the lever, the type of firing lever disclosed in DE 196 13 987 must be exposed on the top of the weapon. Although the risk of collision with foreign objects is indeed reduced by this approach, the possibility still exists. If the shooter is under cover and quickly pulls the weapon up during a flashback, the firing lever can easily hang up on a branch and, thus, cause a loading disorder. Furthermore, due to their design, many weapons cannot employ a top mounted firing lever which is freely accessible from above.

SUMMARY OF THE INVENTION

In accordance with an aspect of the invention, a firing lever mechanism is provided for use with a firearm. The firing lever mechanism includes a slide disposed for reciprocating movement between a distal position and a proximal position. The slide has a locked position between the distal position and the proximal position. The firing lever mechanism also includes a first spring that biases the slide toward the distal position, and a firing lever that is mounted for pivoting movement between a rest position and an operating position. In the rest position, the firing lever is disposed in substantial alignment with the longitudinal axis of the firearm. In the operating position, the firing lever is positioned at an angle to the longitudinal axis of the firearm to facilitate grasping of the firing lever. If, when the firing lever is in the rest position, the firing lever is pivoted through a first predefined angle in a direction away from the operating position, the slide is released from the locked position. The first spring then moves the slide toward the distal position thereby pivoting the lever toward the operating position.

In some embodiments, the firing lever mechanism also includes a locking lever mounted for pivoting movement. The locking lever cooperates with the slide to define the locked position of the slide. The firing lever cooperates with the locking lever to release the slide from the locked position when the firing lever is pivoted through the predefined angle. In some embodiments, the locking lever has a stop pin located at a first end, and the slide has a lock recess located to engage the stop pin when the slide is in the locked position. In some embodiments, the slide defines a contact edge, and the locking lever includes a spring pin at a second end opposite the first end. The first spring engages the spring pin to bias the stop pin of the locking lever against the contact edge of the slide when the slide is in its distal position.

In some embodiments, the slide defines a recess and the spring pin is disposed for movement within the recess. The recess is sized so that, upon retraction of the slide toward the proximal position, the locking lever pivots until the stop pin is positioned to engage the lock recess of the slide when the slide moves toward the distal position.

In some preferred embodiments, the firing lever is adapted for release from the rest position without requiring grasping thereof. Also in some preferred embodiments, the firing lever acts as a pressable trigger for releasing the firing lever.

In some embodiments, the firing lever mechanism is further provided with a second spring and a control plate that cooperates with the second spring and the slide. In such embodiments, a rotational force is applied in a first direction to the firing lever when the slide moves from the locked position to the distal position. A rotational force is applied to the firing lever in a second direction opposite the first direction when the slide moves from the distal position toward the proximal position. In some embodiments, the second spring comprises a double arm spring.

In some embodiments, the first spring comprises a dual action spring simultaneously biasing the slide in a first direction and biasing the locking lever in a second direction different from the first direction. In such embodiments, the first spring may comprise a substantially coiled section for applying a force in the first direction, and a substantially straight section for applying a force in the second direction.

In some embodiments, the firing lever defines a longitudinally running hole, and the firing lever is pivotally mounted on a post cooperating with a bolt assembly. In such embodiments, when the firing lever is in the operating position, it can be moved relative to the post and into contact with a counterstop defined on the bolt assembly.

In some embodiments, the firing lever is located on a first side of the firearm when it is in the operating position. In some such embodiments, the firing lever can be adapted to pivot to a second side of the firearm opposite the first side when it is in the operating position by reversing an orientation of the slide.

In accordance with another aspect of the invention, a firing lever mechanism for use with a firearm is provided. The firing lever mechanism includes a slide disposed substantially within the firearm for reciprocating movement between a distal position and a proximal position. The slide has a locked position between the distal position and the proximal position. The firing lever mechanism also includes a first spring that biases the slide toward the distal position, and a locking lever that is disposed substantially within the firearm for pivoting motion. The locking lever has a first end and a second end. The first end cooperates with the slide to define the locked position. The firing lever mechanism is further provided with a firing lever mounted on the firearm for pivoting movement between a rest position and an operating position. When it is in the rest position, the firing lever is disposed in substantial alignment with the longitudinal axis of the firearm. When it is in the operating position, the firing lever is positioned at an angle to the longitudinal axis of the firearm to facilitate grasping of the firing lever. Additionally, the firing lever mechanism includes a second spring mounted substantially within the firearm, and a control plate cooperating with the second spring and the slide. A rotational force is applied in a first direction to the firing lever when the slide moves from the locked position to the distal position. A rotational force is applied to the firing lever in a second direction opposite the first direction when the slide moves from the distal position toward the proximal position.

In some embodiments, if, when the firing lever is in the rest position, the firing lever is pivoted through a first predefined angle in a direction away from the operating position, the first end of the locking lever is disengaged from the slide to thereby release the slide from the locked position. In such embodiments, the first spring then moves the slide toward the distal position and the control plate pivots the firing lever in the first direction toward the operating position.

In accordance with yet another aspect of the invention, a firing lever mechanism for use with a firearm is provided. The firing lever mechanism includes a firing lever mounted for pivoting movement between a rest position and an operating position. When in the rest position, the firing lever is disposed in substantial alignment with the longitudinal axis of the firearm. When in the operating position, the firing lever is positioned at an angle to the longitudinal axis of the firearm to facilitate grasping of the firing lever. The firing lever mechanism also includes a slide disposed for reciprocating movement between a distal position and a proximal position. The firing lever mechanism is further provided with a first spring for moving the slide along the longitudinal axis upon displacement of the firing lever by a predetermined distance from the longitudinal axis. Additionally, the firing lever mechanism includes means for converting the longitudinal movement of the slide into a rotational force applied to the firing lever to pivot the firing lever toward the operating position.

In accordance with a further aspect of the invention, a method is provided for use with a firearm that has a longitudinal axis and a firing lever mounted for movement between a first position, wherein the firing lever is disposed in substantial alignment with the longitudinal axis, and a second position wherein the firing lever is disposed at an angle to the longitudinal axis. The method includes the steps of loading a first spring to generate a spring force directed along the longitudinal axis of the firearm; pivoting the firing lever in a first direction through a predefined angle relative to the longitudinal axis to release the spring force; converting the spring force into a rotational force; and applying the rotational force to the firing lever to pivot the firing lever in a second direction substantially opposite the first direction toward the second position.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
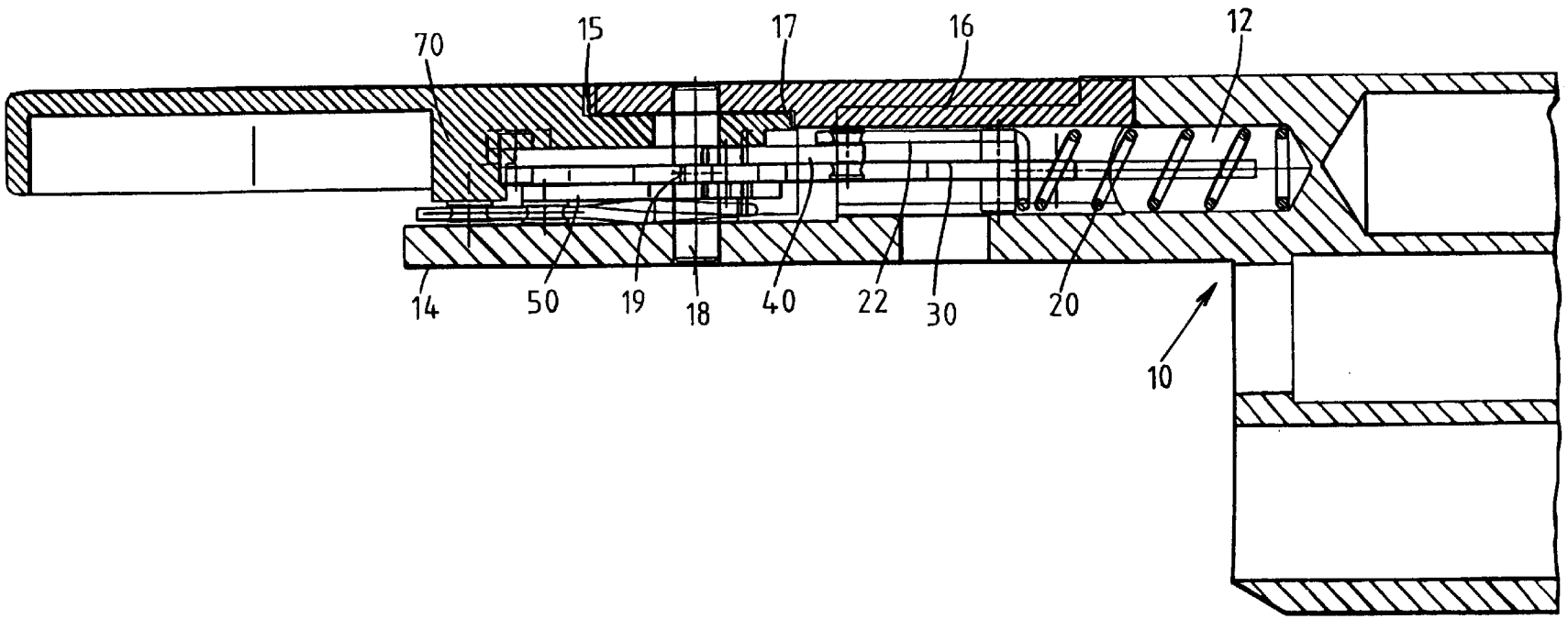
FIG. 1 is a side sectional view of a firing lever mechanism constructed in accordance with the teachings of the instant invention.

A firing lever mechanism constructed in accordance with the teachings of the invention is shown in FIG. 1. In FIG. 1, the mechanism is shown in the position that it assumes in a firearm having a horizontal barrel axis and which is held ready for shooting. The front or distal end of the weapon (i.e., the muzzle of the firearm), is on the left in FIG. 1. The rear or proximal end is on the right in FIG. 1. The top and bottom of the mechanism are located at the top and bottom of FIG. 1, respectively.

Figure 2:
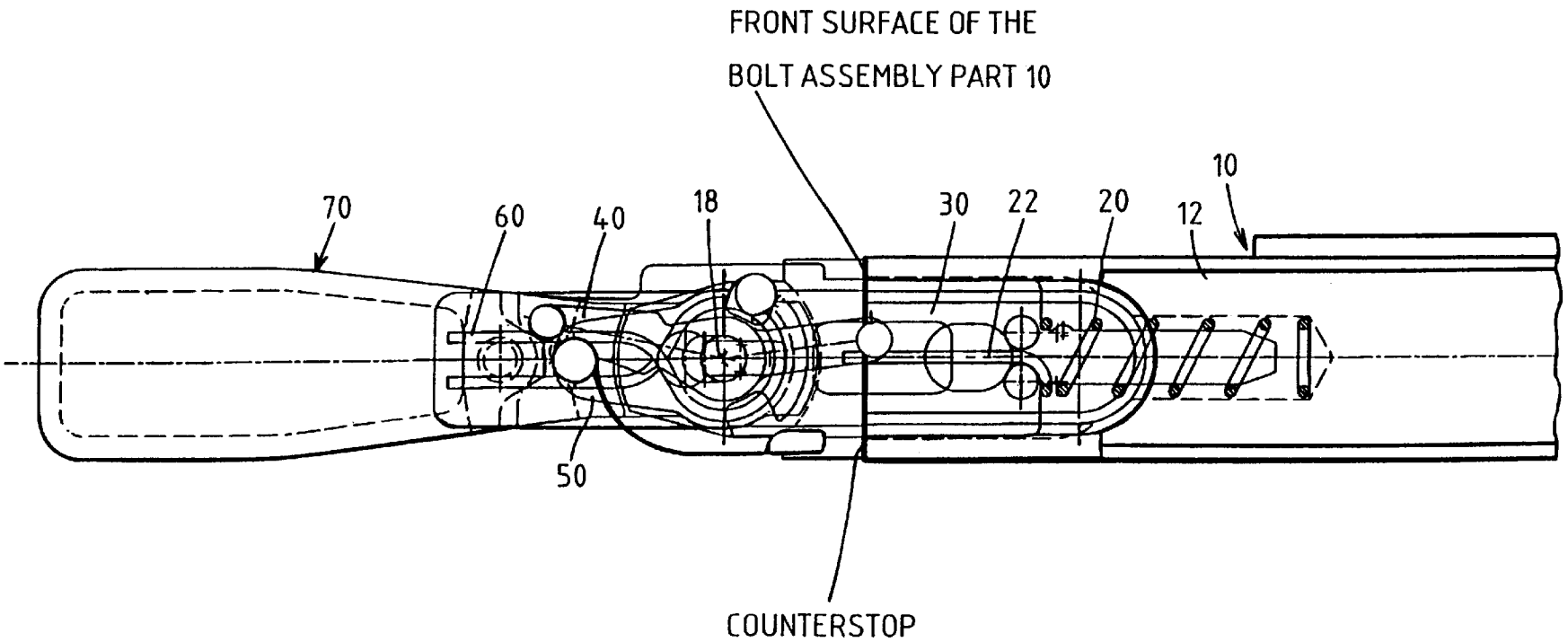
FIG. 2 is a top sectional view of the firing lever mechanism of FIG. 1.

The firing lever mechanism is mounted on a conventional bolt assembly part 10, which is shown broken down in the rear in FIGS. 1 and 2. The bolt assembly part 10 is rigidly connected to a conventional bolt assembly support (not shown) on its back side (not shown). The bolt assembly part 10 has a spring hole 12 designed as a horizontal blind hole open to the front. It also includes a flat, strip-like, horizontal free-supporting firing lever support 14 disposed beneath and adjacent to the spring hole 12. A vertically disposed post 18 that protrudes upward is fastened to the firing lever support 14 in a through-hole located toward the front third of the firing lever mechanism. The post 18 is generally cylindrical with a circular cross-section except for a turned groove 19. The turned groove 19 is in the form of an annular groove with a rectangular cross section. It is located at approximately the center height of the post 18.

A cover plate 16 is securely mounted above the spring hole 12. The cover plate 16 is oriented parallel to the firing lever support 14. The rear section of the cover plate 16 sits on the bolt assembly part 10 and the front section defines a base dimensioned to receive the upper end of the post 18. The front of the cover plate 16 has an upper, semiround leading edge 15 that protrudes forward. A lower, semiround leading edge 17 that is indented backward is situated beneath the upper leading edge recessed to the rear. The leading edges 15, 17 are centered on the post 18.

A coil compression spring 20 is disposed in the spring hole 12. The front end of the spring 20 is formed into a linear bending arm 22 that extends forward near the top of the spring hole 12.

Figure 3:
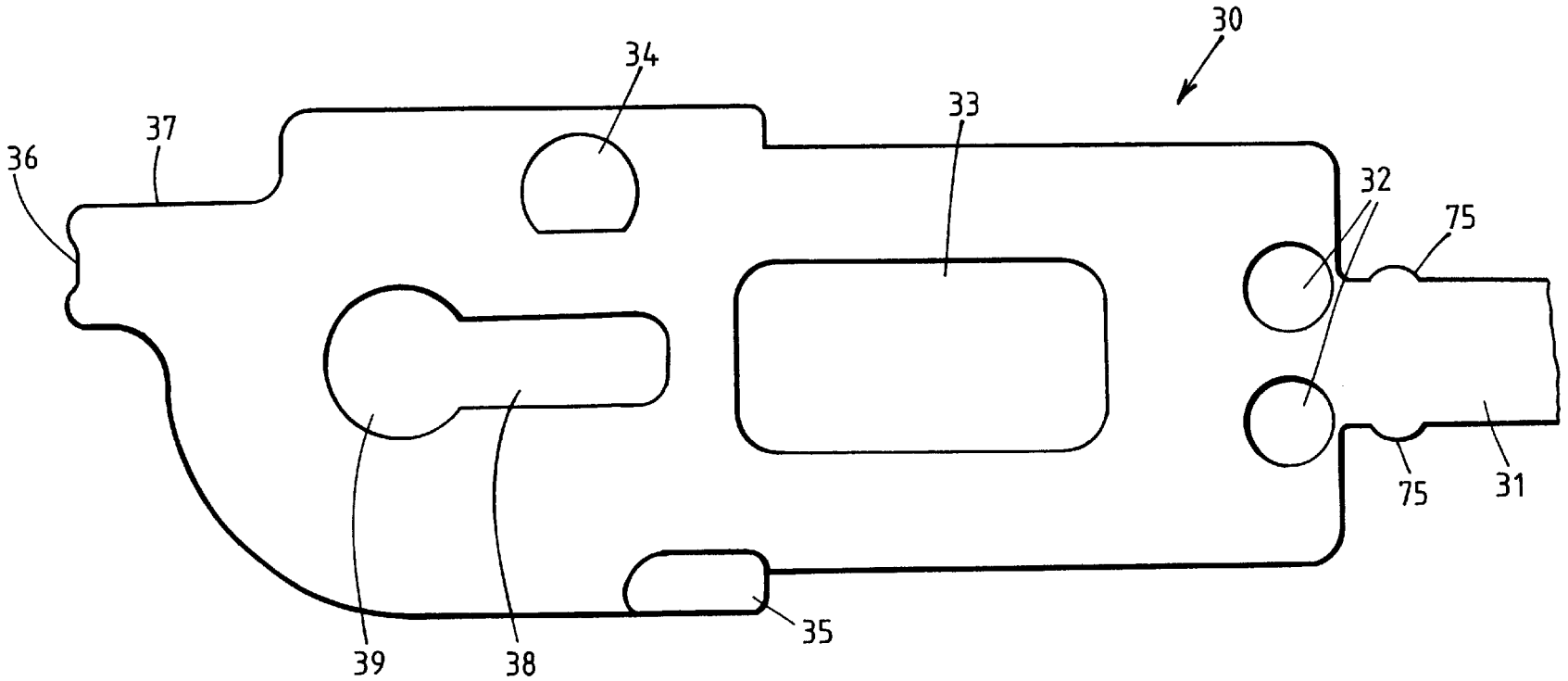
FIG. 3 is a top view of the slide of the firing lever mechanism of FIGS. 1 and 2.

Also shown in FIGS. 1 and 2 is an elongated, essentially flat slide 30 that extends horizontally forward. This slide 30 is mounted within the firearm for reciprocating movement between a proximal position and a distal position. It is biased toward the distal position by the longitudinal force generated by the coil spring 20. A top view of the slide 30 is shown in detail and on an enlarged scale in FIG. 3. The slide 30 includes a rear, center strip extending in the longitudinal direction. This strip forms a spring guide 31 which cooperates with the coil spring 20. The slide 30 also includes a widened, elongated center plate extending in the longitudinal direction. The front of the center plate of the slide 30 is slightly wider than the rear of the center plate. The slide 30 is also provided with a front protrusion extending forward but arranged to the side of the longitudinal center of the slide 30. The front side of the front protrusion ends in an arc-shaped locking recess 36. The protrusion includes two long edges. The long edge that faces away from the center line of the slide 30 forms a support edge 37.

A center round hole 39, the diameter of which is larger than the diameter of the post 18, is defined near the front of the center plate. The center of this round hole 39 is aligned with an elongated hole 38. The center hole 39 and the elongated hole 38 are in communication. To enable the post 18 to slide between hole 39 and hole 38 as the slide 30 reciprocates between the distal and proximal positions, the width of the elongated hole 38 is larger than the diameter of the turned groove 19 of the post 18.

For the purpose of converting the longitudinal movements of the slide 30 into rotational forces as explained further below, the slide 30 includes a bolt 34 attached between a side edge of the slide 30 and the elongated hole 38. The bolt 34 has a flattened side that faces the center of the slide 30. The bolt 34 is located at the right of the elongated hole 38 and extends downward (preferably, perpendicularly to the plane of the center plate). Opposite the bolt 34 is a contact lug 35 that protrudes upward and downward (preferably, perpendicularly to the plane of the center plate). An elongated rectangular recess 33 is defined in the center plate of the slide 30 behind the elongated hole 38. The width of the recess 33 is slightly larger than the diameter of the round hole 39.

To locate the bending arm 22 of the spring 20, two spring mounting pins 32 are disposed on the slide 30 between the rear edge of the recess 33 and the rear end of the slide 30. The spring mounting pins 32 are arranged symmetrically on either side of the center line of the slide 30. The space between the pins 32 corresponds to the diameter of the bending arm 22.

The spring guide 31 is connected to the rear of the slide 30 and has a width dimensioned so that the coiled part of the compression spring 20 can be easily slipped around the guide 31. The spring guide 31 has a bulge 75 on either side at its front end. When assembled, at least one of the bulges 75 is undercut by one turn of the compression spring 20 so that the spring 20 cannot slide off of the spring guide 31.

When the compression spring 20 sits on the spring guide 31, the bending arm 22 is disposed between the two spring mounting pins 32 and extends above the recess 33 as best shown in FIG. 2. The coiled part of the compression spring 20 is then supported on the bottom of the spring hole 12 and biases the slide 30 forward along the longitudinal axis of the firearm toward a distal position.

The bolt 34, the contact lug 35, and the spring mounting pins 32 preferably extend by the same amount to both sides of the slide 30 (i.e., both above and below the center plate). This bi-directional extension permits the slide 30 to be mounted in the position shown in the drawings, and also in the opposite orientation (i.e., with its bottom surface facing upward) to facilitate opposite hand shooting, as is further explained below.

Figure 4:
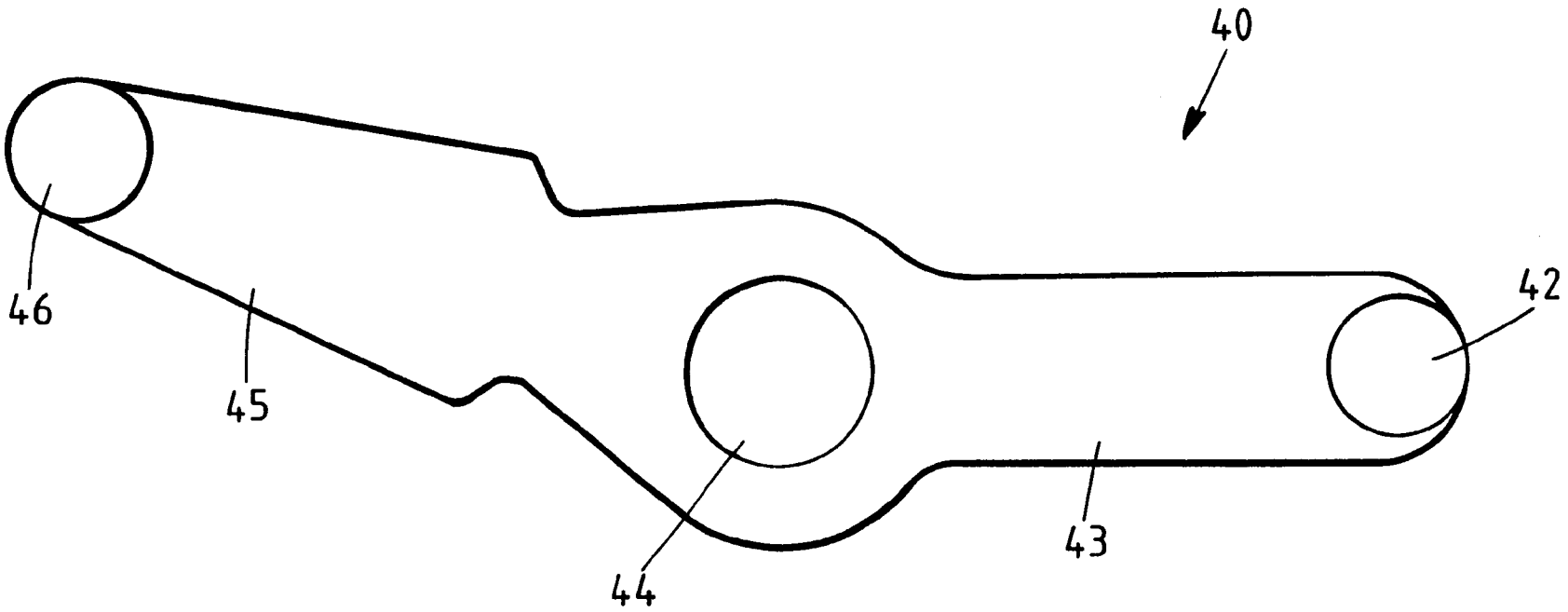
FIG. 4 is a top view of the locking lever of the firing lever mechanism of FIGS. 1 and 2.

For the purpose of releasably securing the slide 30 in a locked position between the distal position and the proximal position, the firing lever mechanism is provided with a locking lever 40. The locking lever 40, which is shown in FIG. 4 on an enlarged scale relative to that of FIGS. 1 and 2, is situated directly above the slide 30. The locking lever 40 is positioned to slide on the surface of the slide 30. The locking lever 40 has two arms 43, 45 which are displaced from one another such that they define about a 165° angle. A hole 44 is defined in the locking lever 40 at the juncture of the arms 43, 45. The hole 44 is sized to receive the post 18 such that, when assembled, the locking lever 40 is mounted to pivot on the post 18. A fixed spring pin 42 protrudes upwardly and downwardly at the rear of the arm 43 and a fixed locking pin 46 protrudes upwardly and downwardly at the front of the arm 45.

When the locking lever 40 is mounted with the post 18 passing through the hole 44, the downwardly protruding section of the spring pin 42 engages in the recess 33 of the slide 30, and the bending arm 22 of the spring 20 lies against the upwardly protruding section of the spring pin 42. The spring 20 is, thus, loaded such that the locking lever 40 is urged in a counterclockwise direction in FIG. 2 whereby the spring pin 42 is pressed against the edge of the recess 33. When the slide 30 is disposed in the locked position depicted in FIG. 2, the locking recess 36 of the slide 30 is forced against the locking pin 46 by the longitudinal force developed by the compression spring 20 thereby preventing the locking lever 40 from pivoting and preventing the slide 30 from moving to its distal position.

Figure 5:
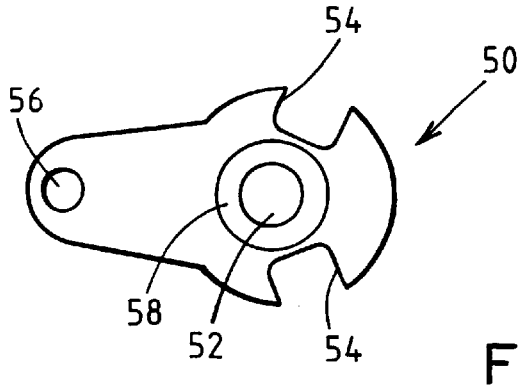
FIG. 5 is a bottom view of the control plate of the firing lever mechanism of FIGS. 1 and 2.

For the purpose of converting longitudinal movements of the slide 30 into rotational movements of the firing lever 70, the firing lever mechanism is provided with an essentially flat control plate 50 (see FIG. 5). When assembled, the control plate 50 is moveable from below and lies against and below the slide 30. The control plate 50 is a single-armed pivot lever. It defines a hole 52 sized to receive the post 18 such that, when assembled, the control plate 50 can be pivoted on the post 18. The distal end of the control plate 50 forms a lever arm which extends forward and carries a groove pin 56 that protrudes downwardly. Two notches 54 are formed in the control plate 50. The notches 54 are located opposite each other on opposite sides of the peripheral section of the control plate 50 surrounding the hole 52. A torus 58 surrounds the hole 52 on the bottom of the control plate 50. The torus 58 protrudes downwardly from the surface of the plate 50. When assembled, the torus 58 lies on the top of the firing lever support 14. Also when assembled, the bolt 34 of the slide 30 engages into one of the notches 54 (which of the two notches is engaged depends on the selected orientation of the slide 30).

Figure 6:
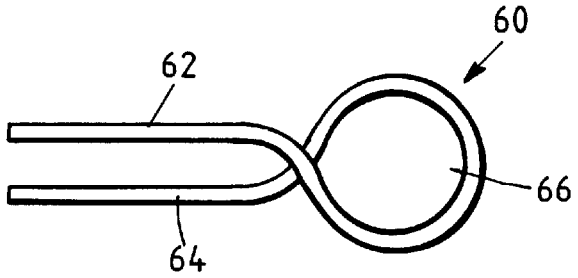
FIG. 6 is a top view of the double-arm spring of the firing lever mechanism of FIGS. 1 and 2.
Figure 7:
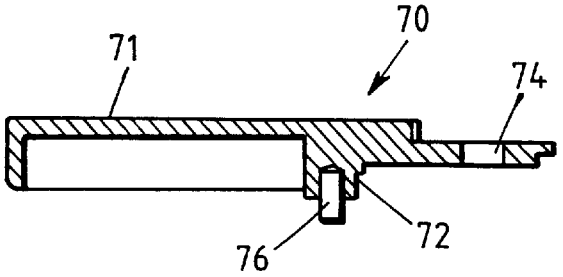
FIG. 7 is a side, cross-sectional view of the firing lever of FIGS. 1 and 2.

Referring now to FIG. 6, the firing lever mechanism is provided with a double-arm spring 60 with an eye 66, a straight first arm 62 protruding from the eye 66, and a second arm 64 arranged parallel to the first arm 62. There is limited spacing between the arms 62, 64. The spring 60 is disposed with the eye 66 on the torus 58 of the control plate 50 such that the arms 62, 64 lie on opposite sides of the groove pin 56.

The locking mechanism is further provided with an elongated firing lever 70 having a rest position, wherein the firing lever 70 is disposed in substantial alignment with the longitudinal axis of the weapon, and an operating position wherein the firing lever 70 is disposed at an angle (preferably 90°) to the longitudinal axis of the weapon. The front section of the firing lever 70 forms a handle 71. The handle 71 is hollowed out from the bottom for weight saving reasons. The rear section of the firing lever 70 defines a firing lever-elongated hole 74. The hole 74 is elongated along the longitudinal axis of the firing lever 70. The firing lever-elongated hole 74 has a width so that it can be easily pivoted about the post 18. In addition, the rear section of the firing lever 70 has two stepped edges in the form of circular arcs. The circular arcs are designed to fit the upper leading edge 15 and the lower leading edge 17 of the cover plate 16. As a result, the firing lever 70 is guided to rotate over a predetermined angular range which is defined by engagement of the stepped edges and the leading edges 15, 17. Preferably, one limit of this angular range is reached when the firing lever 70 is pivoted left by 90°. In this position, the firing lever 70 can be pushed backward along the firing lever-elongated hole 74 (e.g., in a direction transverse to the longitudinal axis of the firearm) for use in applying distally directed forces to the bolt assembly as explained further below.

Figure 8:
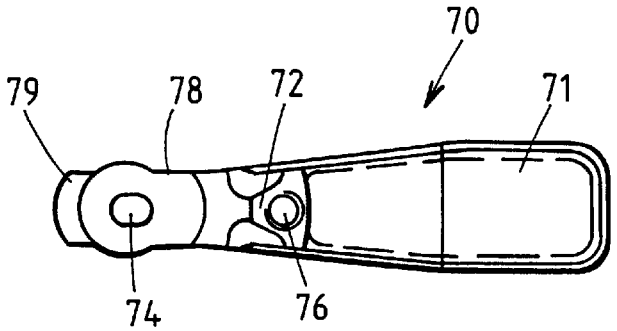
FIG. 8 is a bottom view of the firing lever of FIG. 7.

Two opposite protrusions 72 are formed on the rear end of the handle 71. A downwardly protruding firing lever pin 76 is attached in the center in front of these protrusions 72 (see FIG. 8). When assembled, one of the protrusions 72 lies opposite the downwardly protruding section of the locking pin 46 of the locking lever 40. Also when assembled, the firing lever pin 76 engages between the two arms 62, 64 of the double-armed spring 60 in front of the groove pin 56 of the control part 50, as shown in FIG. 2. A front stop 78 and a rear counterstop 79 are formed on each of the side edges of the firing lever 70 (in front of and behind the firing lever-elongated hole 74).

During assembly, the post 18 is inserted into the firing lever support 14. The double-arm spring 60, the control plate 50, the slide 30 (optionally carrying the spring 20), the locking lever 40 and the firing lever 70 are then mounted on the post 18 in the cited sequence. In order to disengage the force of the compression spring 20, a hole is formed in the bottom of the firing lever support 14 to introduce a tool with which either the compression spring 20 or the slide 30 can be held back. The firing lever mechanism then assumes the arrangement depicted in FIGS. 1 and 2.

In the drawings, the firing lever mechanism is set up for operation from the left, (i.e., with the left hand of the shooter). However, if the slide 30 and the locking lever 40 are mounted with their bottom surfaces up, then the firing lever mechanism will be set up for operation from the right, (i.e., with the right hand of the shooter). A gunsmith or armorer can, therefore, individually adjust the weapon equipped with the firing lever mechanism for right or left shooting.

The positions of the firing lever 70 are depicted in FIGS. 9*a* to 9*e*, with reference to FIG. 2. FIGS. 9*a* to 9*e* illustrate a top view of the firing lever mechanism in which only the handle 71 of the firing lever 70 and the bolt assembly part 10 are visible. The cover plate 16 is not shown for the sake of simplicity.

Figure 9A:
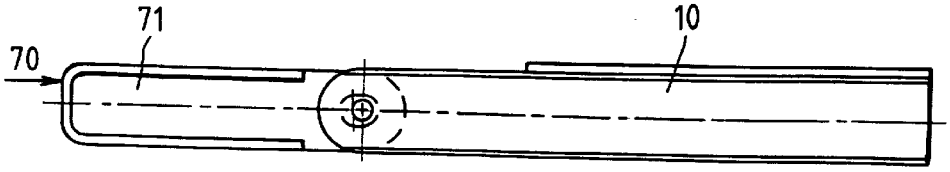
FIGS. 9*a* to 9*e* are schematic illustrations showing different positions that the firing lever can assume during operation.
Figure 9B:
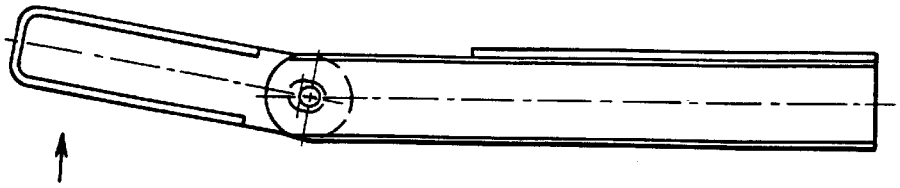

FIG. 9*a* shows the firing lever mechanism in the rest position, which is also shown in FIGS. 1 and 2. In this rest position, the firing lever 70 is aligned with the longitudinal axis of the weapon. The firing lever mechanism may optionally be covered on the top and bottom by other weapon parts, from which it does not protrude laterally. In the rest position, the two arms 62 and 64 of the double-arm spring 60 interact with the firing lever pin 76 to keep the firing lever 70 in its longitudinal alignment with the axis of the firearm.

Figure 9C:
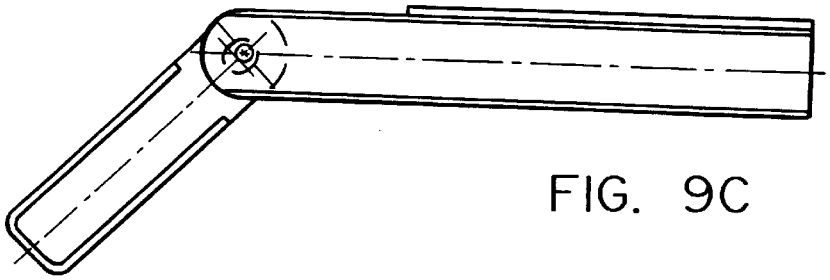

Assuming the firing lever mechanism is arranged for left handed operation as shown in the figures, when the shooter intends to load the weapon, he presses his finger horizontally from the left side against the handle 71 of the firing lever 70 (shown by the arrow in FIG. 9*b*) such that the lever pivots slightly (i.e., is displaced in a direction away from the operating position). When the lever 70 is so pivoted, the protrusion 72 of the firing lever 70 presses against the locking pin 46 of the locking lever 40 and pivots the locking lever 40 against the force of the bending arm 22 of the compression spring 20 acting upon the spring pin 42. When the firing lever 70 is pivoted through a predefined angle, the locking pin 46 is pushed out of the locking recess 36 of the slide 30, and the slide 30 moves forward from the locked position toward the distal position under the force of the compression spring 20. When the slide 30 moves distally, the forward moving bolt 34 carried by the slide 30 engages in the notch 54 of the control plate 50 thereby forcing the control plate 50 to pivot counterclockwise. As the control plate 50 so pivots, the groove pin 56 of the control plate 50 entrains the second arm 64 of the double-arm spring 60. At the same time, when the handle 71 is released by the shooter, the locking pin 46 of the locking lever 40 will be free to pivot back again under the force of the bending arm 22 until the locking pin 46 engages the support edge 37 of the slide 30, which, in the meantime, has moved forward. As shown in FIG. 9*c*, when the handle 71 is released, the firing lever 70 is pivoted counterclockwise by about 45° by the first arm 62 of the double-arm spring 60, which lies against the firing lever pin 76. The handle 71 now protrudes laterally from the weapon and can be grasped without effort by the shooter.

Figure 9D:
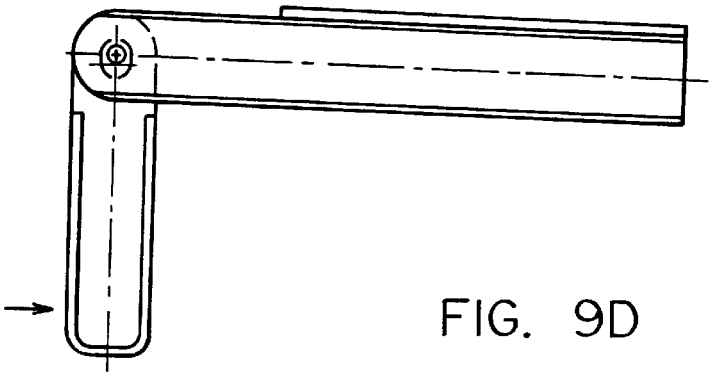
Figure 9E:
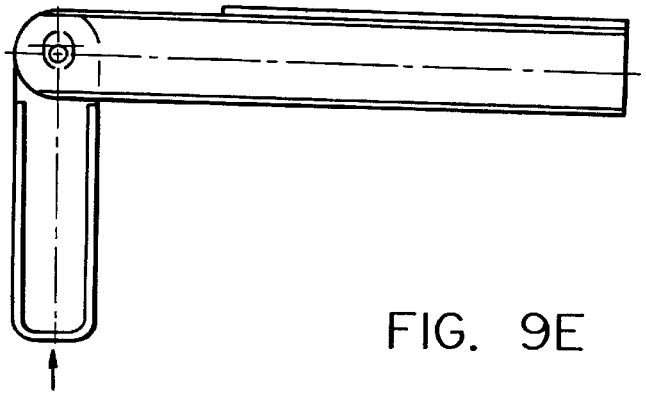

Referring now to FIG. 9*d*, during loading the shooter pulls the handle 71 backward until it protrudes at a right angle from the weapon. In this operating position, the stop 78 of the firing lever 70 is supported against the contact lug 35 of the slide 30 and, upon application of a proximally directed force to the firing lever 70, presses this lug 35 and slide 30 backward against the force of the compression spring 20. As the slide 30 moves proximally, the contact edge 37 of the slide 30 is moved away from under the locking pin 46 of the locking lever 40 so that the locking lever 40 can spring into its initial position under the influence of the leading arm 22 of the spring 20. The engagement of the spring pin 42 with the side edge of the recess 33 of the slide 30 limits backward movement of the locking lever 40 and ensures that the locking pin 46 is situated precisely in front of the locking recess 36 to define the locked position of the slide 30 when the slide 30 moves distally from its proximal position(s). Engagement between the stop 78 and a recess of the bolt assembly part 10 or the cover plate 16 limits the pivoting movement of the firing lever 70.

When the firing lever 70 is released, the slide 30 moves distally under the influence of the coil spring 20. The distal movement of the slide 30 entrains the control plate 50 via engagement of the bolt 34 in the notch 54. This engagement pivots the control plate 50 back in a clockwise direction in FIG. 2. This rotational movement of the plate 50 causes the groove pin 56 to entrain the first arm 62 of the double-arm spring 60 so that the two arms 62, 64 are separated from each other and such that the second arm 64 loads the firing lever 70 via the firing lever pin 76. Since the handle 71 is released, it pivots back to its rest position under the influence of the second arm of the spring 60. The slide 30 moves forward until it reaches its locked position wherein the locking pin 46 sits in the locking recess 36.

When it is desirable to exert a forwardly directed force on the bolt assembly part 10, (perhaps in the case of a load disturbance), the handle 71 is fully pivoted out to the side as explained above. The firing lever 70 is then forced toward the center (shown by the arrow in FIG. 9*e*) of the weapon such that the firing lever 70 is moved in its longitudinal direction over the length of the firing lever-elongated hole 74. This transverse movement causes the counterstop 79 of the firing lever 70 to engage behind a complementary recess on the bolt assembly part 10 or on the cover plate 16 on the side of the center opposite the stop 78. The firing lever 70 is supported on both sides of the center and is, thus, rigidly connected to the bolt assembly part 10. By pulling back the firing lever 70 against the arrow direction in FIG. 9*e* (i.e., by applying a force directed transversely to and away from the longitudinal axis of the weapon), the firing lever 70 can be released for the pivoting movement and functions described above.

If, when the firing lever 70 is situated in the rest position depicted in FIG. 9*a*, it is struck from the right, then no reaction occurs and it remains in the rest position. If, on the other hand, as already described above, the slide 30 and the locking lever 40 are rotated relative to the position shown in the drawings so that these bottom surfaces face up, then applying a force from the right will release (FIG. 9*b*) and pivot (FIGS. 9*c*, 9*d*) the lever to the right in the drawings. In such circumstances, securing of the firing lever to apply a distally directed force to the bolt assembly (FIG. 9*e*) occurs by pressing the firing lever 70 from right to left.

As will be appreciated by persons of ordinary skill in the art, an improved firing lever mechanism for an automatic firearm has been disclosed. In order to enable the firing lever 70 to be covered from the top when in its rest position, a firing lever spring mechanism is provided which can be released without grasping the lever 70. The spring mechanism is released by applying a laterally directed force to the lever 70. When the mechanism is so released, the handle 71 of the firing lever 70 emerges laterally from its protected position (where it is preferably covered on the top and bottom) where it can be grasped without difficulty.

As used herein, the term "spring mechanism" is to be understood in the broadest sense and means a mechanism in which at least one elastic part is present. This elastic part can optionally be the closing spring of the weapon itself In any event, the force generated by the elastic element preferably forces the firing lever 70 with its handle 71 against a pivotable part which can be pivoted by means of a protrusion or the like lying on the outside. Preferably, the pivoting of the pivoting part entrains the handle 71 and moves it outward where it can be easily grasped. As explained above, the elastic element or spring of the spring mechanism is preferably arranged to automatically move the handle outward by its force when a locking device is released.

As will be appreciated from the foregoing, the spring mechanism preferably has a pressable trigger which can be actuated to release the lock. This trigger is arranged such that it can even be operated by a shooter wearing bulky gloves, and is preferably arranged to move laterally to substantially reduce the likelihood that it will be activated by cover material, branches (perhaps during passage through a thicket) or similar foreign objects.

Although persons of ordinary skill in the art will appreciate that a pushbutton can be fitted laterally on the weapon as the trigger without departing from the scope or spirit of the invention, the trigger is preferably formed or operable by the handle 71 of the firing lever 70. Indeed, in the preferred embodiment it is sufficient to press against the handle 71 laterally in order for it to be moved outward into a position capable of being grasped. The weapon therefore requires no additional operating elements. Moreover, since the handle 71 is the element that the trained shooter automatically grasps when he intends to load or must eliminate a load obstruction, no additional training is ordinarily required to operate a weapon incorporating the disclosed spring mechanism. In the disclosed embodiment, the shooter need only touch or gently strike the handle 71 with the fingertip in order to cause it to jump into his hand. A separate loading handle is, therefore, not required.

As explained above, a moving, spring-loaded slide 30 preferably lies against a moving stop pin 46, in which the stop 46 is moved by pressing the handle 71 from the motion path of the slide 30. As also discussed above, the disclosed apparatus is provided with a spring 20 that directly loads the slide 30 and, after release by the stop loads the handle 71 for movement or pivoting. The moving stop 46 preferably forms the trigger. Since the slide 30 is not connected to the handle 71 by a fixed hinge connection, but by a flexible coupling (e.g., a spring), the slide 30 can move after its release even when the handle 71 still remains pressed. If the handle is released, it then moves outward under the action of the spring and can be immediately grasped.

Although persons of ordinary skill in the art will appreciate that the movement of the bolt assembly could be used to return the spring-loaded slide to the rest position without departing from the scope or spirit of the invention, in the disclosed embodiment, the handle 71 preferably moves the slide 30 distally as it approaches the operating position so that the stop 46 can be moved back into the motion path of the slide 30. It is, therefore, possible for the shooter to employ increased load readiness (for example, during guarding of prisoners) by pivoting out the handle 71 and perhaps even grasping it. If no loading process occurs, the handle 71 can be brought back to its rest position by simply moving it into its operating position and releasing it again.

Although persons of ordinary skill in the art will appreciate that the stop 46 could be position on a transversely moveable slit without departing from the scope or spirit of the invention, in the disclosed embodiment the stop 46 is preferably disposed on a pivotable locking lever 40, which is biased by a spring 20 toward the locked position of the slide 30. Preferably, the locking lever 40 is symmetric with respect to the longitudinal center line of the firing lever mechanism such that it can be operated in both directions with appropriate design of the handle 71, the firing lever 70 and the slide 33. This means that the handle 71 release can be adapted to release the slide 33 via the locking lever 40 regardless of whether it is pressed from the right or left. The firing lever mechanism is, therefore, useable for both right-handed and left-handed shooting. In the disclosed embodiment, the stop 46 is off-center. It is, therefore, sufficient to rotate the locking lever 40 180° in order to arrange the firing lever mechanism for use by a right-handed or left-handed shooter.

As discussed above, the slide 33 is preferably loaded by a coiled compression spring 20 which has a lengthened end which loads the locking lever 40. The function of two springs is, thus, fulfilled by one spring 20 and the design of the firing lever mechanism is, therefore, simplified. If the lengthened end is arranged in the center, then it can remain in its position even when the locking lever 40 is rotated for opposite hand shooting.

The fulfillment of two functions by a single spring 20 is also made possible by the fact that the slide 30 cooperates with a pivoting plate 50 that can be pivoted during movement of the slide 30 and which acts on the handle 71 with the spring 60 in order to pivot the handle 71 out of the rest position in one state of the mechanism, and to load the lever 70 in the direction of its rest position when the slide is retracted. In addition, the handle 71 is necessarily returned to its rest position by this spring 60 when the slide 33 is retracted and locked. As a result, the firing lever mechanism need not move forward with the bolt assembly in order to move the handle 71 back to its rest position.

In many cases it is necessary to apply a distal force to the bolt assembly to operate the closure spring, especially when the shooter does not allow the bolt assembly to snap forward, but guides it slowly forward in order to avoid the telltale loading noise. It is then possible that the force of the closure spring is no longer sufficient to lock the bolt assembly or to move the extractor barb over the cartridge edge. To address these circumstances, either an unevenness has been formed in the bolt assembly in order to push the bolt assembly forward with the thumb through the ejection opening, or, as in improved designs, the firing lever mechanism has been designed so that the outwardly moved firing lever 70 can be blocked in its position.

In the disclosed embodiment, the firing lever 70 is provided with a longitudinally running elongated hole 74 and is mounted to pivot on a post rigidly connected to the bolt assembly. When in its operating position, the firing lever 70 can be moved such that the elongated hole slides along the post 18 and the lever 70 moves into a holding position in which it is supported on either side of the hole 74 by counterstops rigidly connected to the bolt assembly. It is, thus, possible to apply a force to the bolt assembly along the longitudinal axis of the weapon with the firing lever 70. If the handle 71 is pulled out from the holding position and released, it will swivel back into its rest position.

Although certain instantiations of the teachings of the invention have been described herein, the scope of the coverage of this patent is not limited thereto. On the contrary, this patent covers all instantiations of the teachings of the invention fairly falling within the scope of the appended claims either literally or under the doctrine of equivalents.

What is claimed is:

1. For use with a firearm having a longitudinal axis, a firing lever mechanism comprising:

a slide disposed for reciprocating movement between a distal position and a proximal position, the slide having a locked position between the distal position and the proximal position;

a first spring biasing the slide toward the distal position; and a firing lever adapted to be mounted for pivotal movement between a rest position wherein the firing lever is disposed in substantial alignment with the longitudinal axis of the firearm and an operating position wherein the firing lever is positioned at an angle to the longitudinal axis of the firearm to facilitate grasping of the firing lever, wherein, when the firing lever is in the rest position, pivoting the firing lever through a first predefined angle in a direction away from the operating position releases the slide from the locked position such that the first spring moves the slide toward the distal position thereby pivoting the lever towards the operating position.

2. A firing lever mechanism as defined in claim 1 further comprising a locking lever mounted for pivoting movement, the locking lever cooperating with the slide to define the locked position of the slide, the firing lever cooperating with the locking lever to release the slide from the locked position when the firing lever is pivoted through the predefined angle.

3. A firing lever mechanism as defined in claim 2 wherein the locking lever has a stop pin located at a first end and the slide has a lock recess located to engage the stop pin when the slide is in the locked position.

4. A firing lever mechanism as defined in claim 3 wherein the slide defines a contact edge, the locking lever includes a spring pin at a second end opposite the first end, and the first spring engages the spring pin to bias the stop pin of the locking lever against the contact edge of the slide when the slide is in its distal position.

5. A firing lever mechanism as defined in claim 4 wherein the slide defines a recess, and the spring pin is disposed for movement within the recess, the recess being sized such that, upon retraction of the slide toward the proximal position, the locking lever pivots until the stop pin is positioned to engage the lock recess of the slide when the slide moves towards the distal position.

6. A firing lever mechanism as defined in claim 1 wherein the firing lever is adapted for release from the rest position without requiring grasping thereof.

7. A firing lever mechanism as defined in claim 1 wherein the firing lever acts as a pressable trigger for releasing the firing lever.

8. A firing lever mechanism as defined in claim 1 wherein, when the firing lever is disposed in the rest position, it is covered from above and below.

9. A firing lever mechanism as defined in claim 1 further comprising:

a second spring; and a control plate cooperating with the second spring and the slide to apply a rotational force in a first direction to the firing lever when the slide moves from the locked position to the distal position, and to apply a rotational force to the firing lever in a second direction opposite the first direction when the slide moves from the distal position toward the proximal position.

10. A firing lever mechanism as defined in claim 9 wherein the second spring comprises a double arm spring.

11. A firing lever mechanism as defined in claim 2 wherein the first spring comprises a dual action spring simultaneously biasing the slide in a first direction and biasing the locking lever in a second direction different from the first direction.

12. A firing lever mechanism as defined in claim 11 wherein the first spring comprises:

a substantially coiled section for applying a force in the first direction; and a substantially straight section for applying a force in the second direction.

13. A firing lever mechanism as defined in claim 1 wherein the firing lever defines a longitudinally running hole, the firing lever being pivotally mounted on a post cooperating with a bolt assembly such that, when the firing lever is in the operating position, it can be moved relative to the post and into contact with a counterstop defined on the bolt assembly.

14. A firing lever mechanism as defined in claim 1 wherein the firing lever is adapted to be located on a first side of the firearm when it is in the operating position.

15. A firing lever mechanism as defined in claim 14 wherein the firing lever can be adapted to pivot to a second side of the firearm opposite the first side when it is in the operating position by reversing an orientation of the slide.

16. A firearm having a longitudinal axis and comprising:

a slide disposed substantially within the firearm for reciprocating movement between a distal position and a proximal position, the slide having a locked position between the distal position and the proximal position;

a first spring biasing the slide toward the distal position;

a locking lever disposed substantially within the firearm for pivoting motion, the locking lever having a first end and a second end, the first end of the locking lever cooperating with the slide to define the locked position;

a firing lever mounted on the firearm for pivotal movement between a rest position wherein the firing lever is disposed in substantial alignment with the longitudinal axis of the firearm and an operating position wherein the firing lever is positioned at an angle to the longitudinal axis of the firearm to facilitate grasping of the firing lever;

a second spring mounted substantially within the firearm; and a control plate cooperating with the second spring and the slide to apply a rotational force in a first direction to the firing lever when the slide moves from the locked position to the distal position, and to apply a rotational force to the firing lever in a second direction opposite the first direction when the slide moves from the distal position toward the proximal position.

17. A firearm as defined in claim 16 wherein, when the firing lever is in the rest position, pivoting the firing lever through a first predefined angle in a direction away from the operating position disengages the first end of the locking lever from the slide to thereby release the slide from the locked position such that the first spring moves the slide toward the distal position and the control plate pivots the lever in the first direction toward the operating position.

18. For use with a firearm having a longitudinal axis, a firing lever mechanism comprising:

a firing lever adapted to be mounted for pivotal movement between a rest position wherein the firing lever is disposed in substantial alignment with the longitudinal axis of the firearm and an operating position wherein the firing lever is positioned at an angle to the longitudinal axis of the firearm to facilitate grasping of the firing lever;

a slide disposed for reciprocating movement between a distal position and a proximal position;

a first spring for moving the slide along the longitudinal axis upon displacement of the firing lever by a predetermined distance from the longitudinal axis; and means for converting the longitudinal movement of the slide into a rotational force applied to the firing lever to pivot the firing lever toward the operating position.

19. For use with a firearm having a longitudinal axis and a firing lever mounted for movement between a first position wherein the firing lever is disposed in substantial alignment with the longitudinal axis and a second position wherein the firing lever is disposed at an angle to the longitudinal axis, a method comprising the steps of:

loading a first spring to generate a spring force, the spring force being directed along the longitudinal axis of the firearm;

pivoting the firing lever in a first direction through a predefined angle relative to the longitudinal axis to release the spring force;

converting the spring force into a rotational force; and applying the rotational force to the firing lever to pivot the firing lever in a second direction substantially opposite the first direction toward the second position.

* * * * *